US005191304A

United States Patent [19]

Jachowski

[11] Patent Number: 5,191,304

[45] Date of Patent: Mar. 2, 1993

[54] BANDSTOP FILTER HAVING SYMMETRICALLY ALTERED OR COMPENSATED QUARTER WAVELENGTH TRANSMISSION LINE SECTIONS

[75] Inventor: Douglas R. Jachowski, Redwood City, Calif.

[73] Assignee: Orion Industries, Inc., Solon, Ohio

[21] Appl. No.: 661,874

[22] Filed: Feb. 27, 1991

Related U.S. Application Data

[63] Continuation-in-part of Ser. No. 487,628, Mar. 2, 1990, Pat. No. 5,065,119.

[51] Int. Cl.[5] ..... H01P 1/20

[52] U.S. Cl. ..... 333/202; 333/245

[58] Field of Search ..... 333/202-212, 333/263, 33, 35, 235, 34, 230, 245

[56] References Cited

U.S. PATENT DOCUMENTS

| | | | |
|---|---|---|---|
| 2,851,666 | 9/1958 | Käch | 333/212 X |
| 3,840,828 | 10/1974 | Linn et al. | 333/202 |
| 4,449,108 | 5/1984 | Endo et al. | 333/202 |
| 4,468,644 | 8/1984 | Teague et al. | 333/205 |
| 4,823,098 | 4/1989 | DeMuro et al. | 333/206 |
| 4,843,356 | 6/1989 | Lusignan et al. | 333/238 X |
| 4,862,122 | 8/1989 | Blair, Jr. et al. | 333/202 |
| 5,065,119 | 11/1991 | Jachowski | 333/202 |

FOREIGN PATENT DOCUMENTS

| | | |
|---|---|---|
| 58-141005 | 8/1983 | Japan . |
| 58-157201 | 9/1983 | Japan . |
| 60-246101 | 12/1985 | Japan . |
| 1358980 | 7/1974 | United Kingdom . |

OTHER PUBLICATIONS

Matthaei et al., "Design of Microwave Filters, Impedance-Matching Networks, and Coupling Structures", vol. 1, Jan. 1963, pp. 296-300.

Akao et al., "A Quarter-Wave Coupled Band-Rejection Filter with Maximally Flat Pass-Band Characteristics", Electronics & Comm. in Japan, vol. 52-B, No. 8, 1969, pp. 94-102.

"Waveguide Bandstop Elliptic Function Filters", by J. David Rhodes in the IEEE Transactions on Microwave Theory & Tech., Nov., 1972, pp. 715-718.

"Design Tables for an Elliptic-Function Band-Stop Filter (N=5)", by B. M. Schiffman in the IEEE Transactions, Oct., 1966, pp. 474-482.

"Realization of Dual Mode Band Rejection Filters", by R. Snyder published in the 1979 Proceedings of IEEE Microwave Theo. & Tech., Sympo.

*Primary Examiner*—Robert J. Pascal

*Assistant Examiner*—Seung Ham

*Attorney, Agent, or Firm*—Dressler, Goldsmith, Shore, Sutker & Milnamow, Ltd.

[57] ABSTRACT

A multi-resonator notch filter incorporates a variable impedance transmission line with impedance values going from a relatively low value and increasing upward to a relatively high value then back down to a relatively low value again. A plurality of resonant cavities is coupled to the relatively high central impedance line section of the filter at odd multiples of quarter wavelength intervals. Other resonators can be coupled to lower impedance sections of the transmission line. The locations of selected resonators on the quarter wavelength intervals can be altered thereby increasing and decreasing the nominal quarter wavelength intervals of selected internal pairs by a predetermined amount thereby providing acceptable levels of performance with fewer resonators.

44 Claims, 14 Drawing Sheets

102
102a
102b
INPUT PORT
OUTPUT PORT
$R_{LOAD}$
TEFLON
TEF
REX
AIR
104a
104b
104c
104d
104e
104f
104g
106a
106b
106c
106d
106e
108a
108b
108c
108d
110
90°
90° + $X_{12}$
90° + $X_{23}$
90° - $X_{12}$
90° - $X_{23}$
L
100

103
102a
102b
INPUT PORT
OUTPUT PORT
$R_{LOAD}$
TEFLON
TEF
REX
AIR
106a
106b
106c
106d
106e
106f
122a
122b
124a
124b
90°
90° + $X_{12}$
90° + $X_{23}$
90° - $X_{12}$
90° - $X_{23}$
L
120

Fig. 16
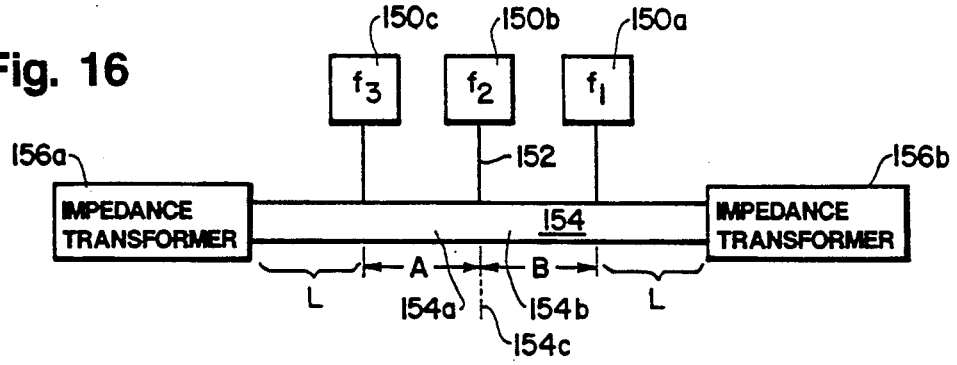
Fig. 17
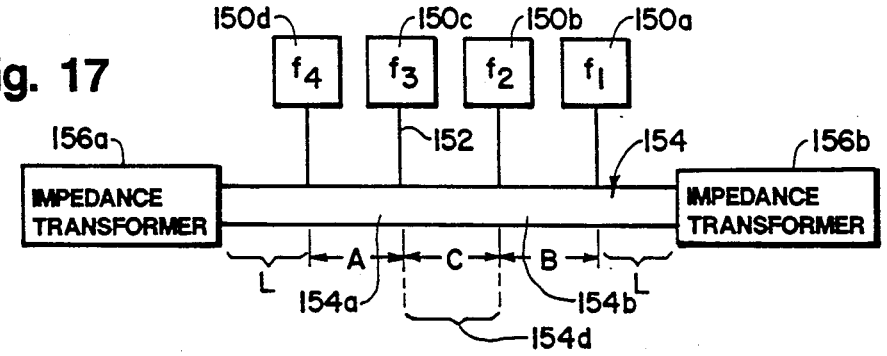
Fig. 18
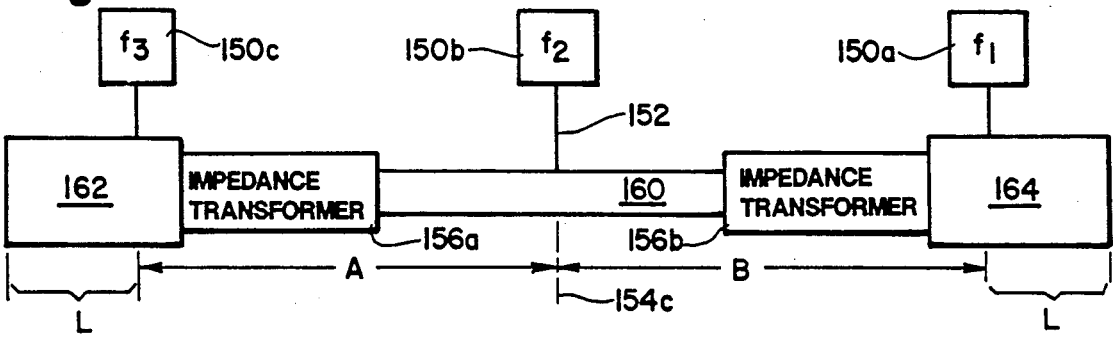
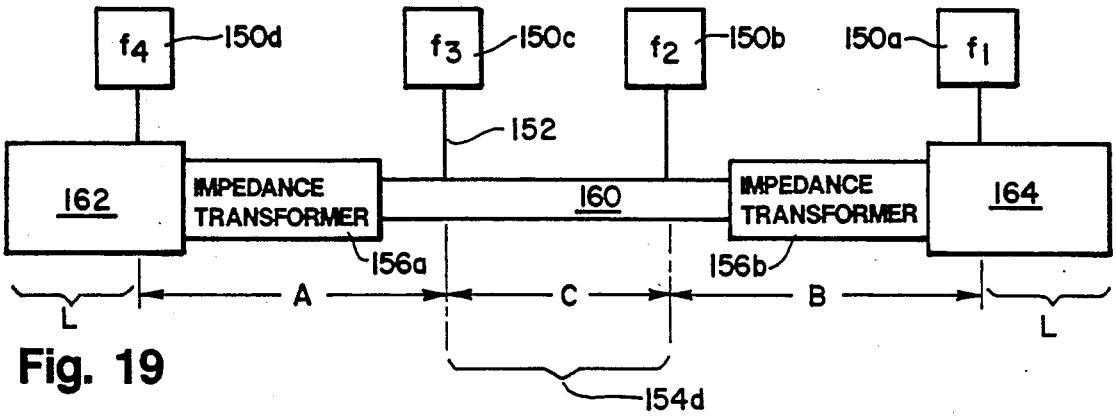
Fig. 19

BANDSTOP FILTER HAVING SYMMETRICALLY ALTERED OR COMPENSATED QUARTER WAVELENGTH TRANSMISSION LINE SECTIONS

This is a continuation-in-part of U.S. Pat. application Ser. No. 07/487,628 filed Mar. 2, 1990, and now U.S. Pat. No. 5,065,119.

FIELD OF THE INVENTION

The invention pertains to band reject, or "notch", filters. More particularly, the invention pertains to improved band reject filters realized using a plurality of resonators in combination with a stepped or graded impedance transmission line.

BACKGROUND OF THE INVENTION

Conventional RF and microwave narrow-band bandstop filters generally consist of a length of transmission line or waveguide to which multiple one-port bandstop resonators are coupled—either by direct contact, by probe, by loop, or by iris—at spacings of approximately an odd multiple of a quarter wavelength, usually either one quarter wavelength or three quarter wavelengths. The individual resonators are typically quarter-wavelength transmission line resonators, cavity resonators, or dielectric resonators.

It is also known to provide some means of tuning the frequency of the resonators, since manufacturing tolerances and material properties make resonator frequencies too unpredictable to guarantee optimum filter performance. Usually, the characteristic impedance of the transmission line is held constant along its length. Filters have been implemented utilizing stripline technology resulting from a design method which produces very specific impedance values in a stepped impedance transmission line. (Schiffman and Young, "Design Tables for an Elliptic-Function Bandstop Filter N=5", *IEEE Transactions on Microwave Theory and Techniques.* Vol. MTT-14 No. 10, October, 1966, pages 474–481). Such designs, however, tend to suffer from a more complex configuration, stringent dimensional tolerances, unsuitability to narrow band applications and excessive pass band loss.

With prior art narrow-band bandstop filters, the unloaded Q of all of the resonators must be maximized to achieve the best performance, while their level of coupling to the transmission line must be individually adjusted to obtain the best performance. Unfortunately, given a transmission line of constant impedance, the optimum values of these couplings may exceed the maximum achievable, or desirable, with a given coupling method. For a fixed number of resonators, the performance of the filter then becomes limited by the maximum achievable coupling rather than by maximum obtainable unload Q of the resonators. Under such circumstances, the optimum filter performance cannot be realized.

While equal-ripple stop band, constant-impedance transmission line notch filters are known, and given a maximum achievable or desirable level of coupling of the resonators to the transmission line, it would be desirable to achieve:

- similar or better performance (notch depth, selectivity, and bandwidth) with fewer resonators,
- greater notch selectivity (ratio of notch floor width to width between passband edges) with similar or better notch depth, and greater notch depth (greater level of band rejection) with similar or better notch selectivity.

In addition, from a manufacturing and installation point of view, it would be desirable to achieve reduced sensitivity of each resonator's characteristic resonant frequency to the coupling mechanism which couples between the resonator and the transmission line. This would provide improved mechanical and temperature stability for the filters, better repeatability of electrical performance from device to device, and less interaction between the tuning of the coupling and the tuning of the resonant frequency of a resonator.

Further, it would be desirable to be able to create a variety of notch filters using a plurality of relatively standard elements such as resonators, transmission line segments and coupling elements without having to create a large variety of specialized components which are only usable with a given filter design.

SUMMARY OF THE INVENTION

Notch filters in accordance with the present invention utilize a plurality of substantially identical resonators and a stepped or graded impedance transmission line. The transmission line has an input end and output end. Further, a first selected, centrally located section of the line has a relatively high impedance value with at least some of the members of the plurality of resonators coupled to the line and selectively spaced from one another.

Selective spacing of the resonators is on the order of an odd number of quarter wavelengths of the nominal center frequency of the filter. Thus, the resonators can be spaced one quarter wavelength from one another or three quarter wavelengths from one another.

Such filters also include first and second quarter wavelength impedance transforming sections with a first transformer section coupled to the input end of the transmission line and with the second transformer section coupled to the output end thereof. Each of the transformer sections has an impedance value which is less than the impedance value of the transmission line.

An input signal can be applied to the first impedance transformer section and a load can be coupled to the second impedance transformer section. The described notch filters provide high performance with a deep, though relatively narrow, attenuation region.

The resonators are tuned to different frequencies in either consecutively increasing or decreasing frequencies along the filter. The incremental increase and decrease in tuned frequencies from the nominal center frequency of the filter can be the same for a given pair of resonators.

A notch filter can be implemented with two or more resonant cavities, some of which will be spaced along the relatively high impedance, central, transmission line section. Others of the resonators may be spaced along the quarter wave impedance transformer sections, each of which has an impedance less than that of the transmission line. Still others may be spaced along input and output transmission line segments having yet lower impedance values.

The filters can be implemented with either a relatively straight transmission line segment or a folded transmission line segment which results in a smaller physical package. Resonators are spaced from one another along the relatively high impedance transmission line on the order of an odd number of quarter wavelengths.

The resonator units can be implemented with cylindrical conductive housings containing dielectric resonator members. The resonator units can be implemented with adjustable resonant frequencies for purposes of setting up and tuning the filter. The resonators each include an adjustable coupling loop. Increasing the value of the characteristic impedance of the transmission line through the interior region of the filter effectively increases the coupling to the respective resonators.

In yet another embodiment, the lengths of members of pairs of selected sections of the transmission line, linking adjacent resonators, can be respectively increased and decreased by predetermined amounts. Such modifications result in filters requiring fewer resonator cavities for achieving substantially the same level of performance as is achievable with quarter wavelength transmission line sections.

Additionally, selected transmission line sections, linking adjacent resonators, can be reduced in length a fixed amount for a given filter. This reduction takes into account or compensates for the effects the coupling elements have on effective line length. By way of example, the compensating reduction in length of quarter wavelength sections can be in a range of eleven to twelve degrees of the center frequency of the filter.

Numerous other advantages and features of the present invention will become readily apparent from the following detailed description of the invention and the embodiments thereof, from the claims and from the accompanying drawings in which the details of the invention are fully and completely disclosed a part of this specification.

BRIEF DESCRIPTION OF THE DRAWING

FIG. 16 is a block diagram schematic of a 3 resonator filter in accordance with the present invention;

FIG. 17 is a block diagram schematic of a 4 resonator filter in accordance with the present invention;

FIG. 18 is a block diagram schematic of another 3 resonator filter in accordance with the present invention; and FIG. 19 is a block diagram schematic of another 4 resonator filter in accordance with the present invention.

DETAILED DESCRIPTION OF THE PREFERRED EMBODIMENTS

Figure 1:
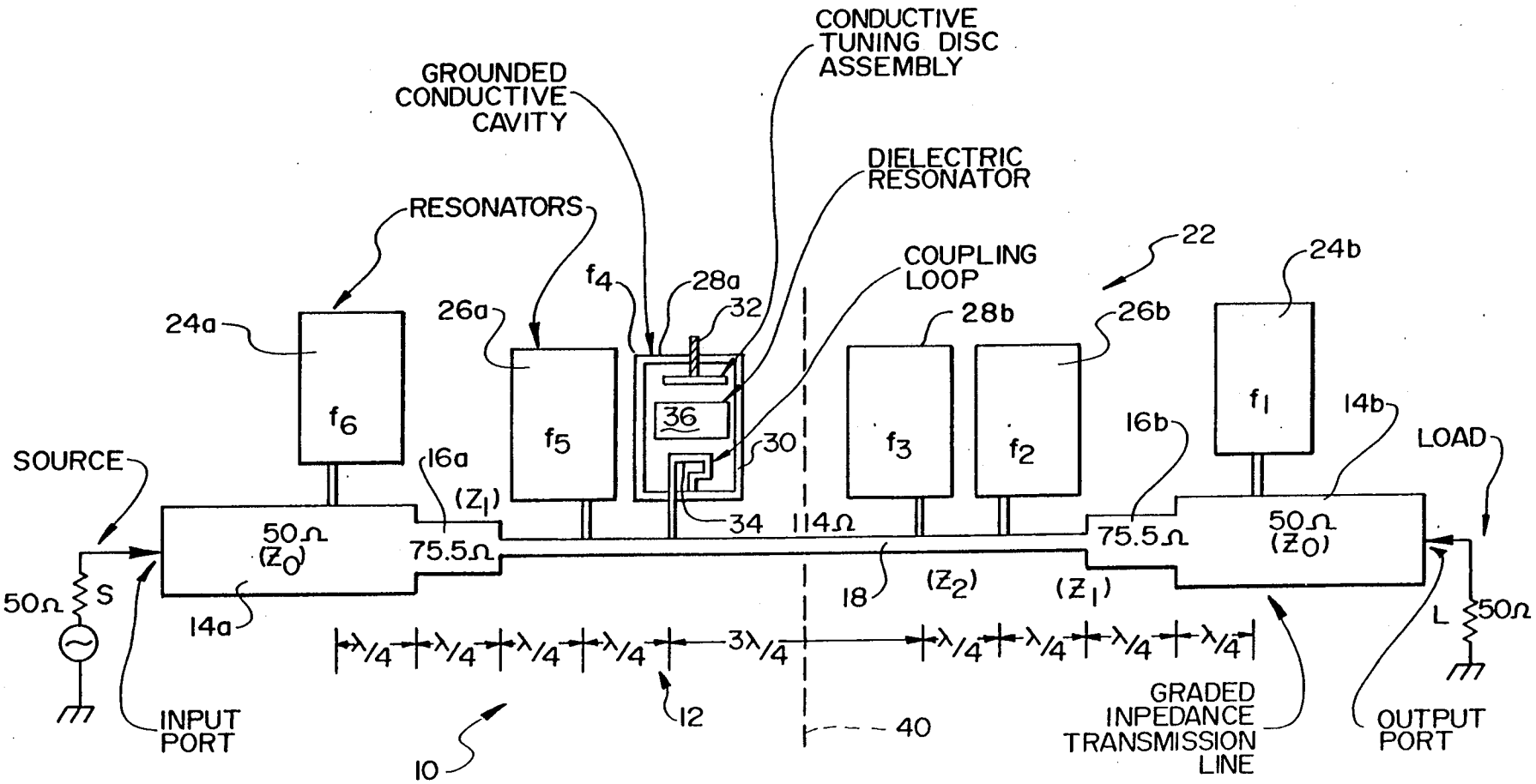
FIG. 1 is an overall block diagram of a filter in accordance with the present invention having six resonators.

While this invention is susceptible of embodiment in many different forms, there is shown in the drawing and will be described herein in detail specific embodiments thereof with the understanding that the present disclosure is to be considered as an exemplification of the principles of the invention and is not intended to limit the invention to the specific embodiment illustrated.

The present invention relates to a family of notch filters which have common structural characteristics. A stepped impedance, common transmission line provides a signal path between input and output ports of the filter.

A plurality of resonators is used for creation, in part, of the desired filter characteristics. At least some of the resonators are electrically coupled to a relatively high impedance section of the transmission line. Other resonators can be coupled to lower impedance sections of the transmission line.

Coupled to each end of the relatively high impedance transmission line is a quarter wavelength impedance transformer. The impedance transformer sections have a lower impedance than the central section of the transmission line. It will be understood that other types of impedance transformers can also be used.

Input and output signals can be applied to and derived directly from the impedance transformer sections. Alternately, a lower impedance transmission line section, with the same impedance as the source or the load can be coupled to each of the quarter wave impedance transformers.

Additional resonators can be coupled to the input and output transmission line sections to further improve and/or refine the filter performance characteristics.

With respect to FIG. 1, a notch filter 10 is illustrated. The filter 10, illustrated in block diagram form, can be coupled to a source S having, for example, a 50 ohm characteristic impedance and a load having, for example, a 50 ohm impedance.

The filter 10 includes a stepped impedance, multi-element transmission line generally indicated at 12. The transmission line 12 includes 50 ohm input and output transmission line sections **14*a* and 14*b***.

Each of the 50 ohm sections **14*a* and 14*b* is in turn coupled to a quarter wave impedance transformer section 16*a* and 16*b*. Each quarter wave impedance transformer 16*a* and 16*b* has a characteristic impedance value which exceeds the impedance value of the input and output transmission line sections 14*a* and 14*b***.

A central, higher impedance transmission line section 18 is coupled between each of the impedance transformer 16*a* and 16*b*. The transmission line section 18 has, in the present instance, a characteristic impedance on the order of 114 ohms. The quarter wave transformer sections 16*a* and 16*b* each have a nominal impedance value on the order of 75.5 ohms (actual realized value was 71.2 ohms). The input and output transmission line sections 14*a* and 14*b* each have a standard nominal characteristic impedance of 50 ohms (actual realized value was 49.8 ohms).

A plurality of substantially identical resonators 22 is coupled to various elements of the multi-impedance transmission line 12. For example, resonators 24*a* and 24*b* are each coupled to a respective input or output transmission line segment 14*a* or 14*b*. The resonators 24*a* and 24*b* are spaced one-quarter wavelength from the adjacent respective impedance transformer 16*a* or 16*b*.

Resonators 26*a* and 26*b* are coupled to the high impedance segment 18. Each of the resonators 26*a* and 26*b* is located one quarter wavelength away from the respective impedance transformer 16*a* or 16*b*.

Resonators 28*a* and 28*b* are also each coupled to the high impedance transmission line segment 18. The resonators 28*a* and 28*b* are each located one quarter wavelength away from the respective resonators 26*a* and 26*b* and are spaced from each other an odd number of quarter wavelengths.

Each of the resonators 24–28 consists of a high Q dielectric resonator 36 supported with low loss dielectric within a conductive cylindrical housing 30, illustrated with respect to resonator 28. Each of the resonators includes an adjustable, conductive, frequency tuning disk assembly 32.

Further, each of the resonators includes an adjustable coupling loop 34 for coupling to the adjacent transmission line segment. It will be understood that alternate coupling members such as probes or irises could be used without departing from the spirit and scope of the present invention.

The coupling loop 34 can be rotated during set up and tuning to obtain the amount of coupling which optimizes filter performance. The coupling loop 34 has an axis which is preferably lined up with an edge of the resonator 36.

The transmission line 12 includes an outer, hollow conductor which could, for example, have a square or rectangular inner cross section and a wire inner conductor. The inner conductor is supported along its length. Support can be provided either by a dielectric material, such as TEFLON or REXOLITE, which is used to set the impedance value of a section or by relatively thin dielectric supports when the desired impedance and geometry of the line require air as the dielectric material.

The characteristic impedance value of each of the various sections such as 14*a*, 14*b*, 16*a*, 16*b* and 18 is established by adjusting the dimensions of the inner and outer conductors as well as the dielectric constant and dimensions of the supporting material in each of those sections. The values of each of the respective impedances are approximately related in accordance with the following well known equation:

$$Z_1^2 = Z_0 * Z_2$$

The filter 10, it should be noted is symmetric about a center line 40. The resonators are tuned in ascending or descending order to achieve the desired overall filter performance.

It will be understood that while the above values are preferred that physical realizations of the filter 10 may result in variations from the indicated values. One advantage of the structure of filter 10 is that over-all filter performance is not significantly impacted by such variations since resonators 24–28 have adjustable coupling to the transmission line and adjustable resonant frequencies.

The resonators are tuned in ascending or descending frequency order to achieve the desired overall filter performance. In filter 10, resonator 24*a* is tuned to the highest stopband frequency f6 while resonator 26*a* is tuned to the next lower frequency f5, and so on, with resonator 24*b* tuned to the lowest stop band frequency, f1. Just as the resonators are symmetrically placed about the physical centerline of the filter, the frequencies that the respective cavities are tuned to tend to be approximately symmetric about the center frequency of the filter, as is evident in the graphs of the measured filter frequency response.

Table 1 lists an exemplary set of frequencies, $f_1$ through $f_6$, for a filter as in FIG. 1 with a center stop band frequency $f_o$. In Table 1 all frequencies or variations thereof are in MHz.

TABLE 1

| | | |
|---|---|---|
| $f_1$ = 845.240 = | $f_0$ − 0.510 | |
| $f_2$ = 845.360 = | $f_0$ − 0.390 | |
| $f_3$ = 845.585 = | $f_0$ − 0.165 | $f_0$ = 845.750 |
| $f_4$ = 845.875 = | $f_0$ + 0.125 | |
| $f_5$ = 846.140 = | $f_0$ + 0.390 | |
| $f_6$ = 846.260 = | $f_0$ + 0.510 | |

FREQUENCY PLAN FOR 6 RESONATOR FILTER

Figure 2:
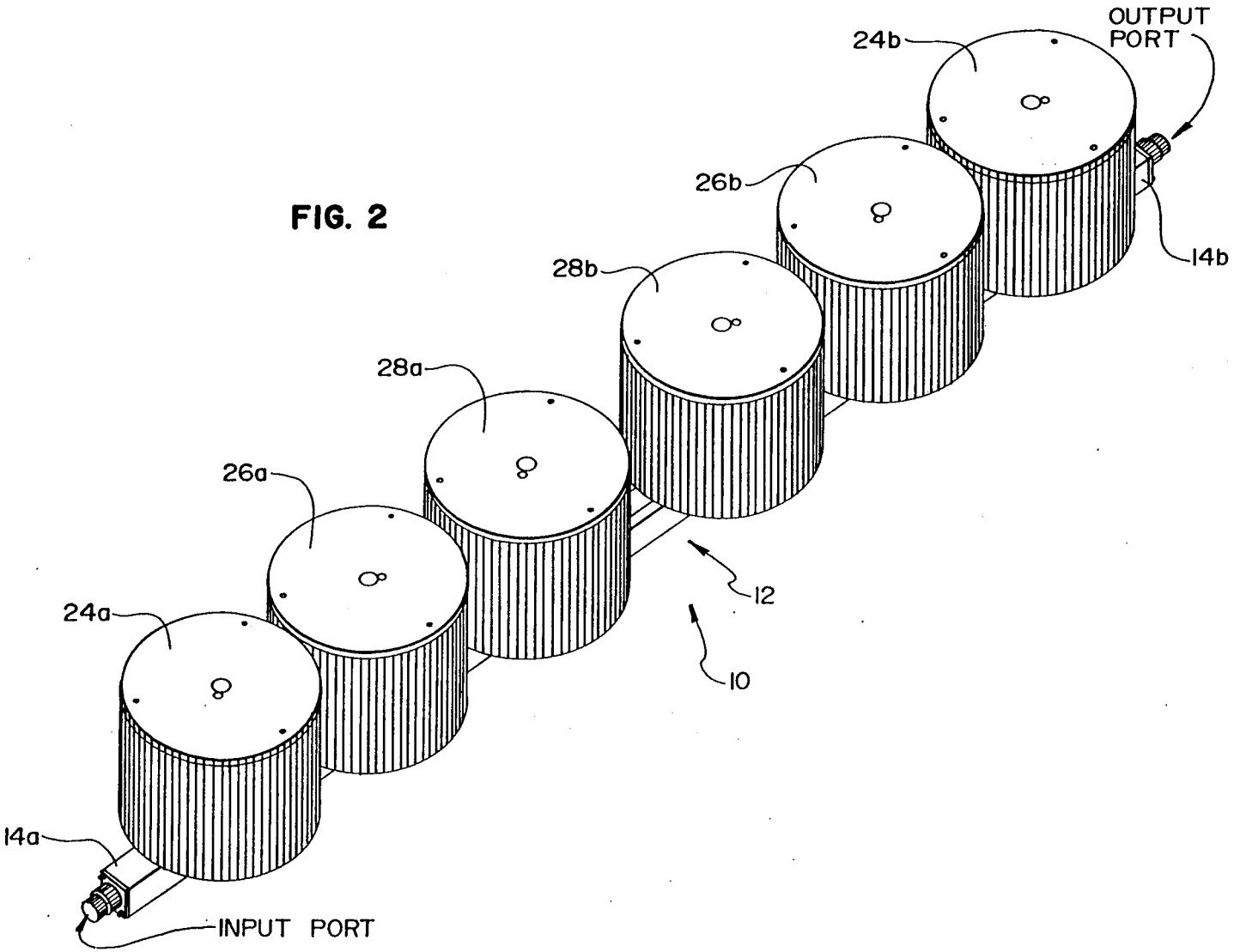
FIG. 2 is a perspective mechanical view of the filter of FIG. 1.

FIG. 2 is a perspective view of the filter illustrating relative placement of the resonators 24–28 along the stepped impedance transmission line 12. As illustrated in FIG. 2, the filter 10 utilizes an essentially straight transmission line 12.

Each of the resonators in the filter 10 has a diameter on the order of 5.5 inches. The total overall filter length from input port to output port is on the order 38.5 inches.

The filter 10 has been designed to have a −20 dB stopband bandwidth of 1.0 MHz centered between passband −0.8 dB band edges at 845 MHz and 846.5 MHz. In addition, it has been designed to have an insertion loss of less than 0.3 db at 835 MHz and 849 MHz.

Figure 3A:
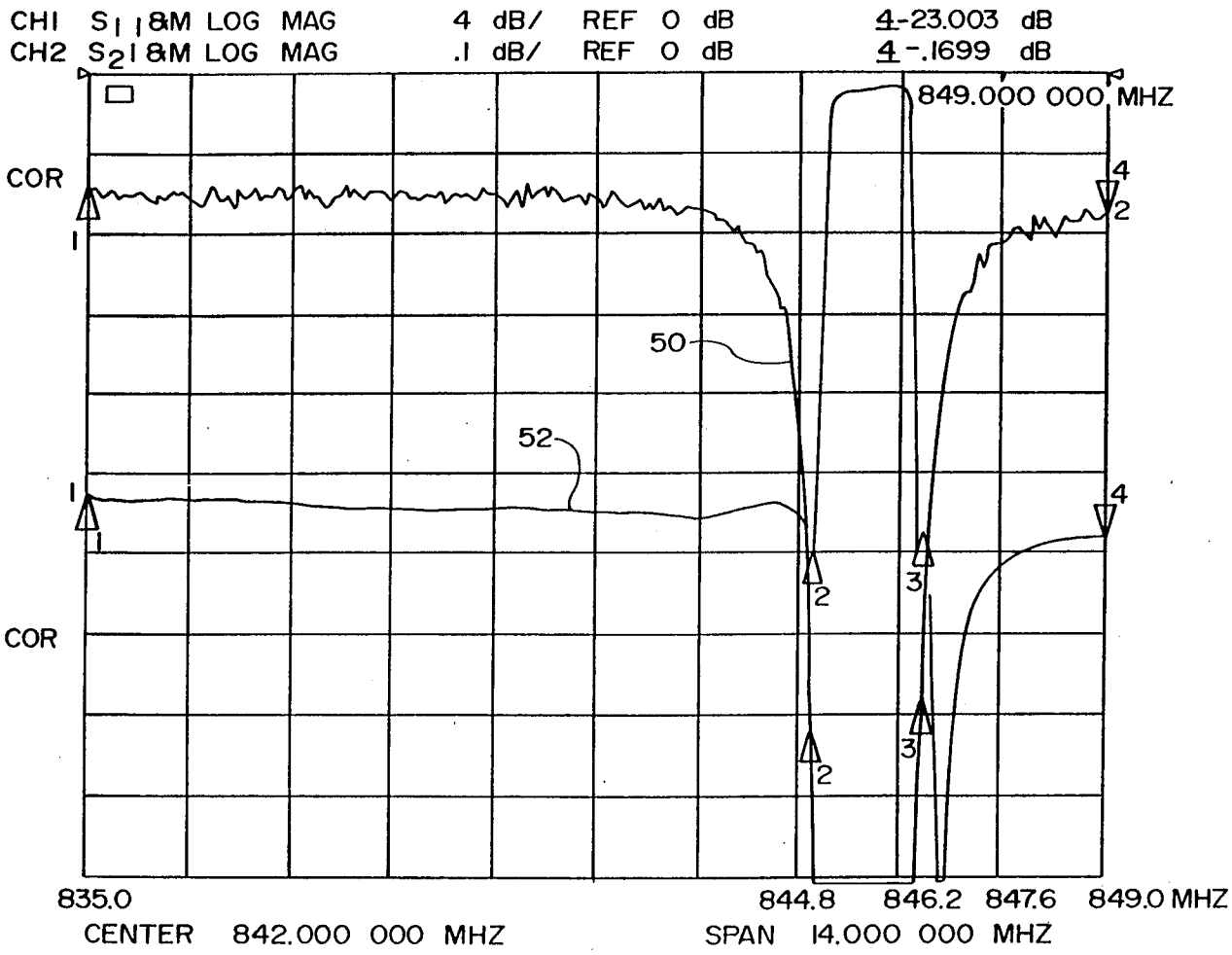
FIG. 3A is a graph illustrating relatively broadband frequency characteristics of the filter of FIG. 1.

FIG. 3A is a graph 50 illustrating the measured gain (S21) of a physical realization of the filter 10 as in FIG. 2 over a 14 MHz bandwidth from 835 MHz to 849 MHz. Each horizontal division of the graph 50 of FIG. 3 corresponds to 1.4 MHz while each vertical division corresponds to 0.1 dB.

As illustrated by the graph 50, the filter 10 exhibits a highly selective notch in its frequency characteristic in the 845 to 846.5 MHz range.

A second graph 52 on FIG. 3 illustrates the input return loss (S11) of the filter 10 over the same frequency range. Each vertical division for the graph 52 corresponds to 4 dB.

Figure 3B:
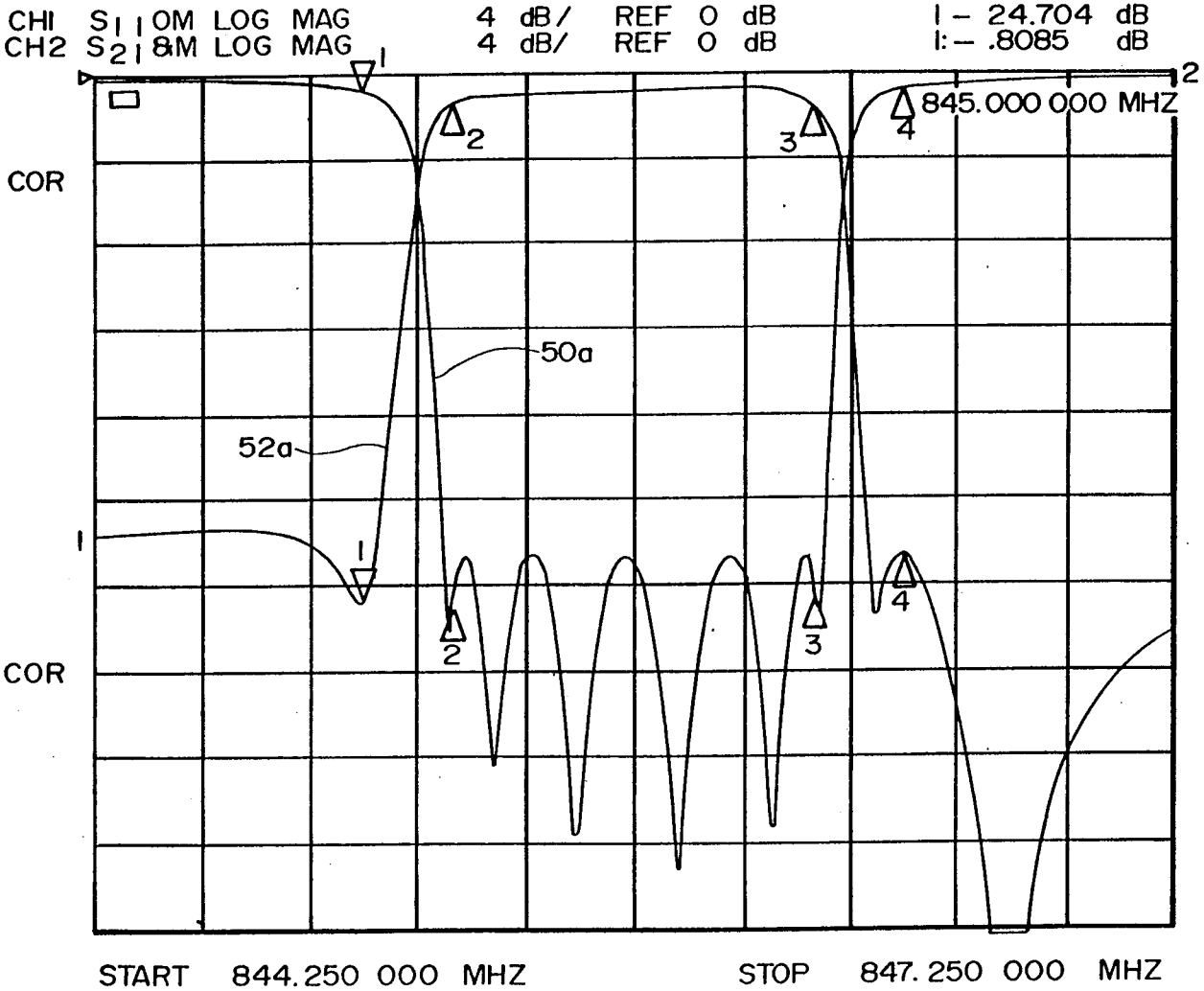
FIG. 3B is a second graph illustrating relatively narrow band characteristics of the filter of FIG. 1.

FIG. 3B illustrates in detail the notch characteristic of the filter 10. A graph 50*a* is the gain of the filter 10 over an 844.25 to 847.25 MHz bandwidth. Each vertical division of FIG. 3B corresponds to 4 dB. Graph 52a is the input return loss for the filter 10 over the same frequency range. In graph 50a each of the minimums, such as 50b, 50c, corresponds to a frequency to which a respective resonator 26b, 28b has been tuned.

Again with respect to the filter 10 of FIG. 2, the overall cross sectional shape of the transmission line 12 is square with exterior dimensions on the order of 1"×1".

Figure 4:
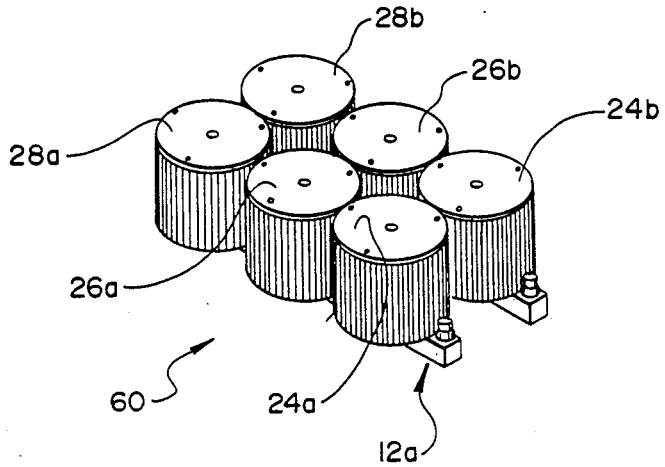
FIG. 4 is a perspective view of an alternate embodiment of the filter of FIG. 1.

FIG. 4 illustrates an alternate six resonator configuration 60. The filter 60 has a block diagram which corresponds to the block diagram of FIG. 1 and has the same number of resonators. Each resonator has the same basic configuration as in the filter 10.

The filter 60 is folded and is physically smaller lengthwise than the filter 10. The filter 60 includes a folded multi-stepped transmission line 12a, having stepped impedances corresponding to the impedances of the transmission line 12. However, the transmission line 12a has a rectangular cross-section with the height of ⅜ of an inch and a width of one inch. It can be formed by milling out a channel in an aluminum block.

Figure 5A:
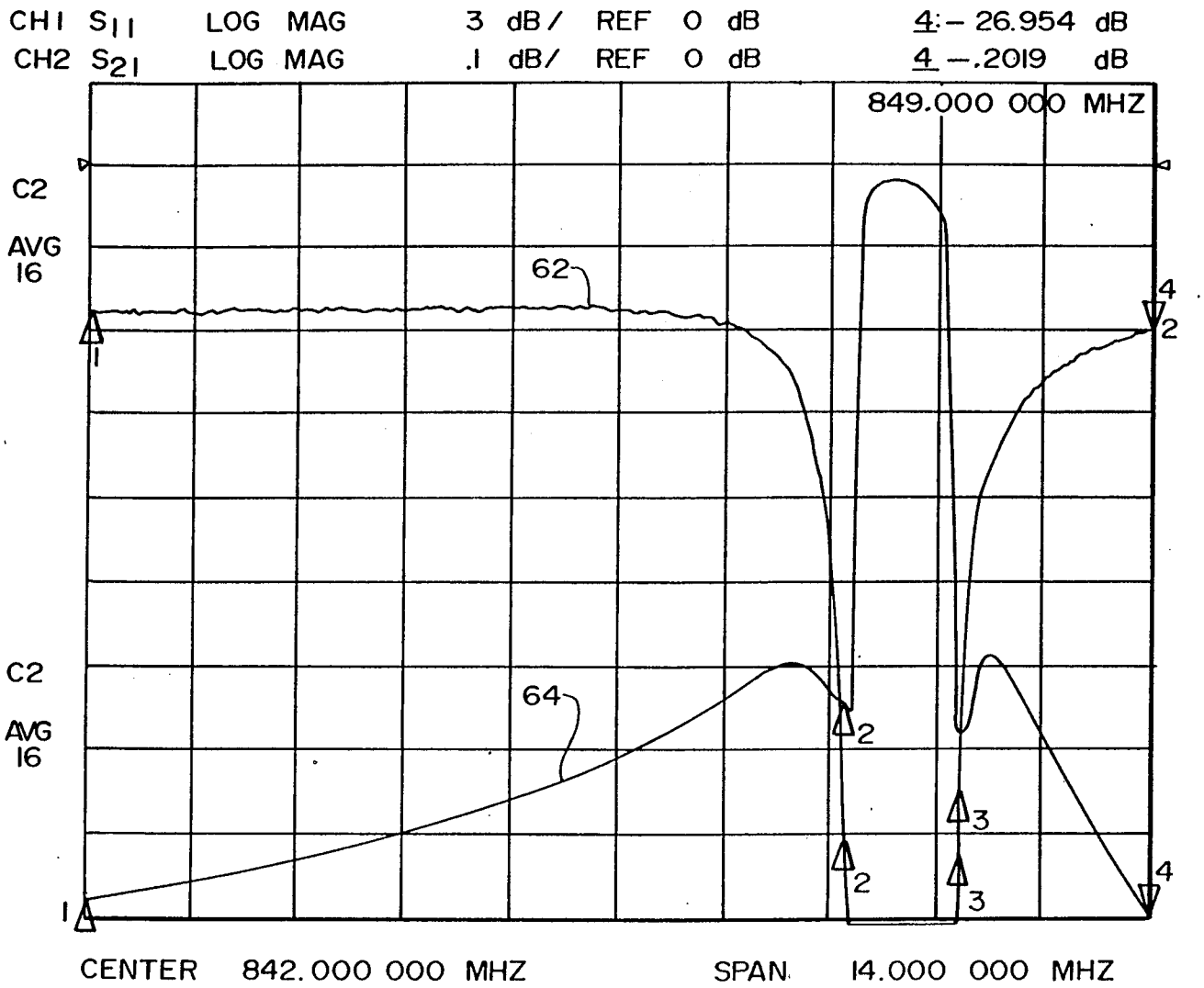
FIG. 5A is a graph illustrating relatively broadband frequency characteristics of the filter of FIG. 4.

FIG. 5A is a plot corresponding to that of FIG. 3A illustrating the filter gain (S21) versus frequency response 62 of the filter 60 as well as the input return loss 64 over the same frequency range 835 MHz to 849 MHz as in FIG. 3A. The vertical scale for the return loss 64 is 0.1 dB/division, while the vertical scale for the insertion loss 62 is 3 dB/division.

Figure 5B:
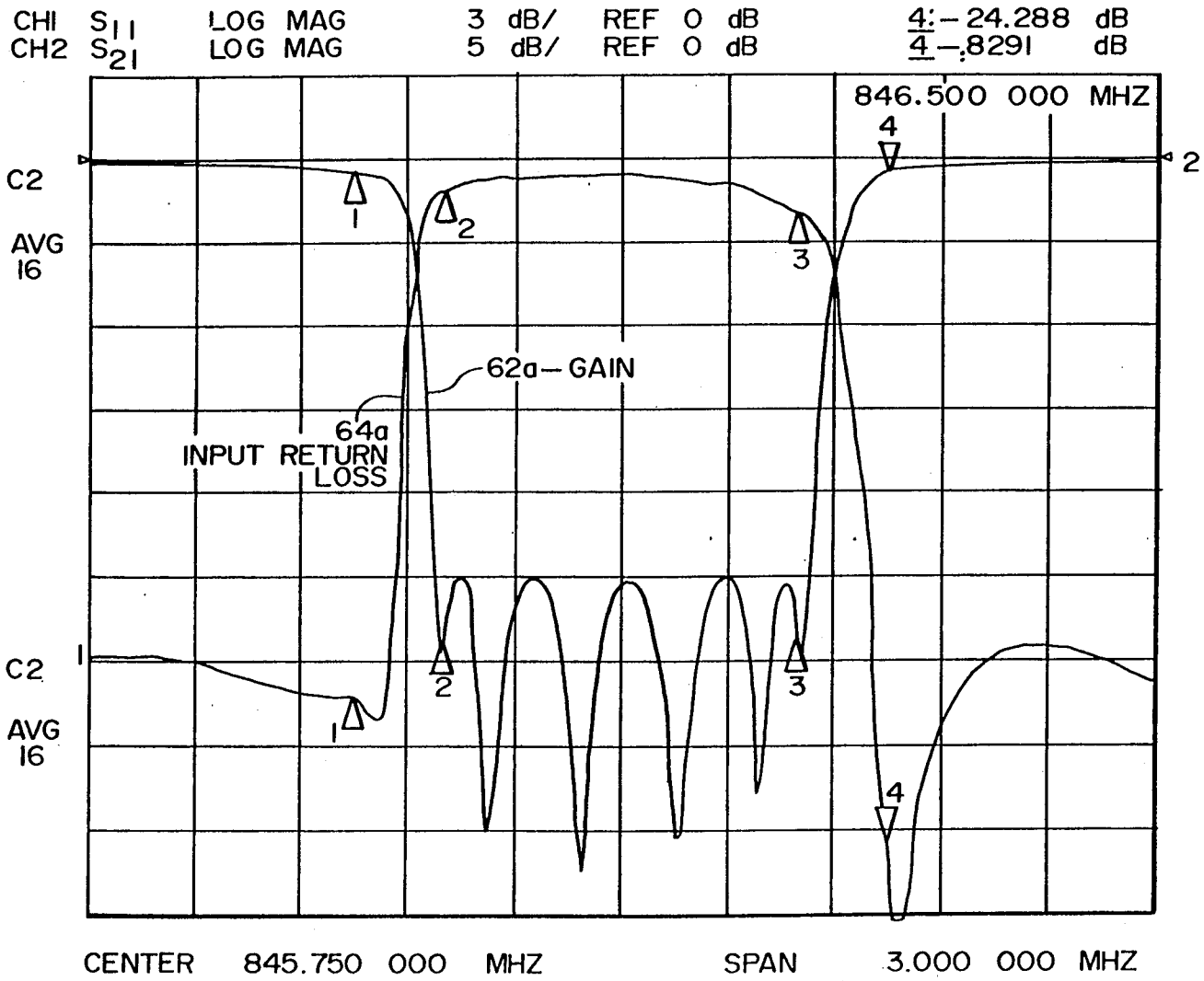
FIG. 5B is a second graph illustrating relatively narrow band characteristics of the filter of FIG. 4.

FIG. 5B illustrates the notch characteristic of filter 60 with horizontal divisions as in FIG. 3B. The insertion loss vertical scale is 5 dB/division and the return loss vertical scale is 3 dB/division.

The folded filter 60 is on the order of 18.25 inches long and 11.0 inches wide.

Figure 6:
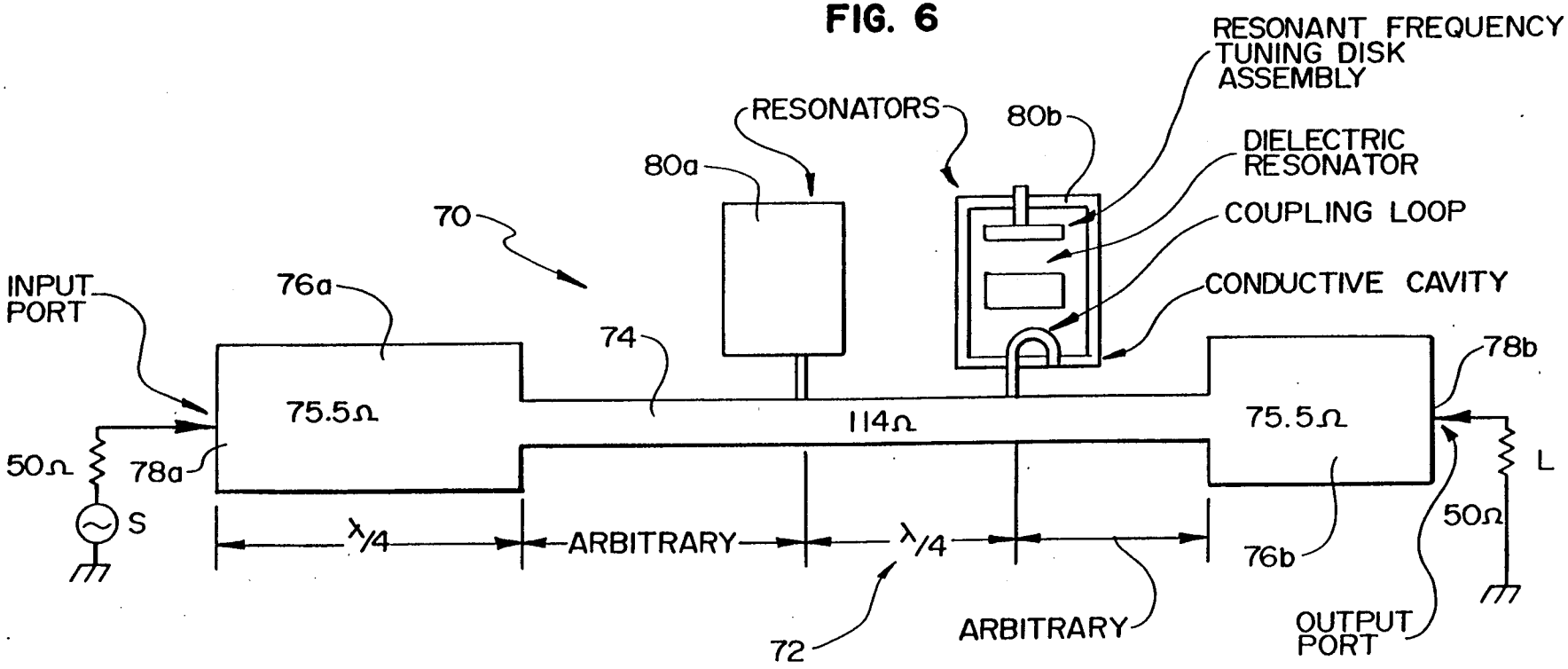
FIG. 6 is an overall block diagram of a filter having two resonators.

FIG. 6 is a block diagram of a two resonator filter 70. The filter 70 includes a stepped impedance transmission line 72 with a relatively high impedance central section 74 which is connected at each end thereof to quarter wave impedance transformers 76a and 76b. The filter 70 can be fed at an input port 78a from a source S of characteristic impedance $Z_{OS}$ (for example 50 ohms) and will drive a load L of impedance $Z_{OL}$ (for example 50 ohms) from an output port 78b.

The filter 70 also includes first and second resonators 80a and 80b which are of the same type of resonators previously discussed with respect to the filter 10. The resonators 80a and 80b are coupled to the high impedance transmission line section 74 and are spaced from one another by approximately one quarter wavelength of the center frequency of the filter 70.

The filter 70 provides a −18 dB deep, 200 KHz wide notch in a frequency band 849.8 to 850.0 MHz with less than 0.3 dB insertion loss at 849 MHz. The filter 70 (as well as the filter 10) can be provided with enhanced performance by shortening the quarter wavelength section between resonators 80a and 80b about 13% or an amount in the range of eleven to twelve degrees of the nominal center frequency of the notch of the filter.

Figure 7:
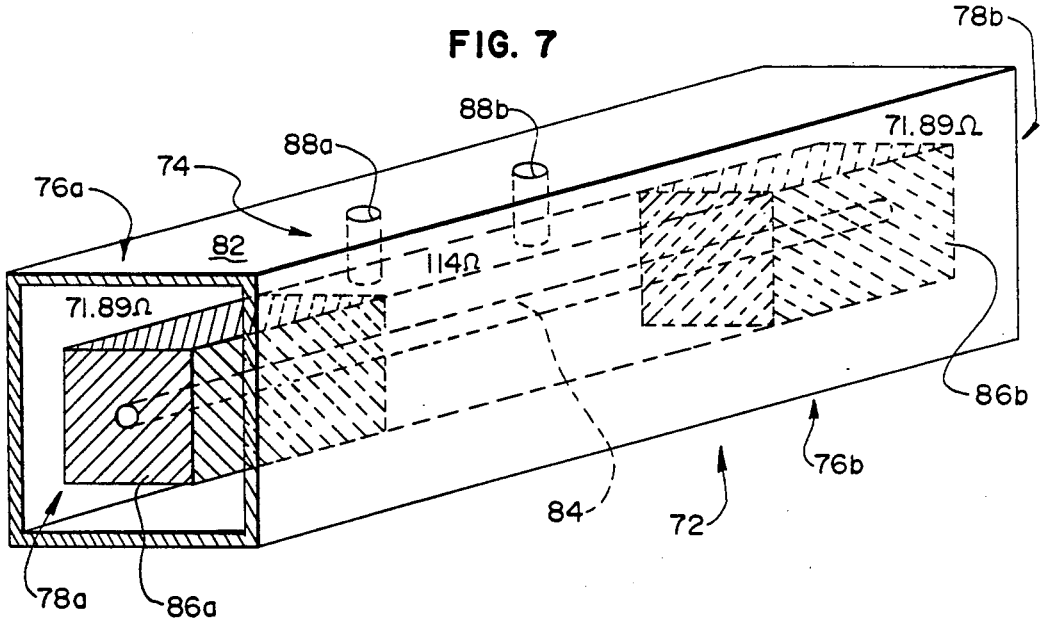
FIG. 7 is a perspective view, partly broken away, of the stepped impedance line of the filter of FIG. 6.

FIG. 7 is a perspective view partly broken away of the transmission line 72 of the filter 70. The transmission line 72 has a generally square cross-section with an outer metal housing 82 with dimensions on the order of 1"×1". The housing 82 could be formed for example of aluminum.

An interior conductor 84 extends within the exterior metal housing 82 and has a circular cross section. The conductor 84 can be formed of copper-clad steel wire for example. Such wire has a lower coefficient of thermal expansion than does copper.

The interior conductor 84 is supported by dielectric members 86a and 86b, each of which also has a square cross-section. The metal housing 74 includes first and second ports 88a and 88b which receive an elongated coupling member from a resonator coupling loop, such as the coupling loop 34.

The overall length of the transmission line 72 is on the order of 11½ inches with the high impedance region 74 having a length on the order of 7 inches and an impedance Z2 on the order of 114 ohms. The two quarter wavelength impedance transforming sections 76a and 76b each have a length on the order of 2.2 inches.

The impedance transforming sections 76a and 76b each include a dielectric material available under the trademark REXOLITE. The impedance Z1 of realized versions of the section 76a and 76b is on the order of 71 ohms as opposed to the design value of 75.4 ohms.

Figure 8:
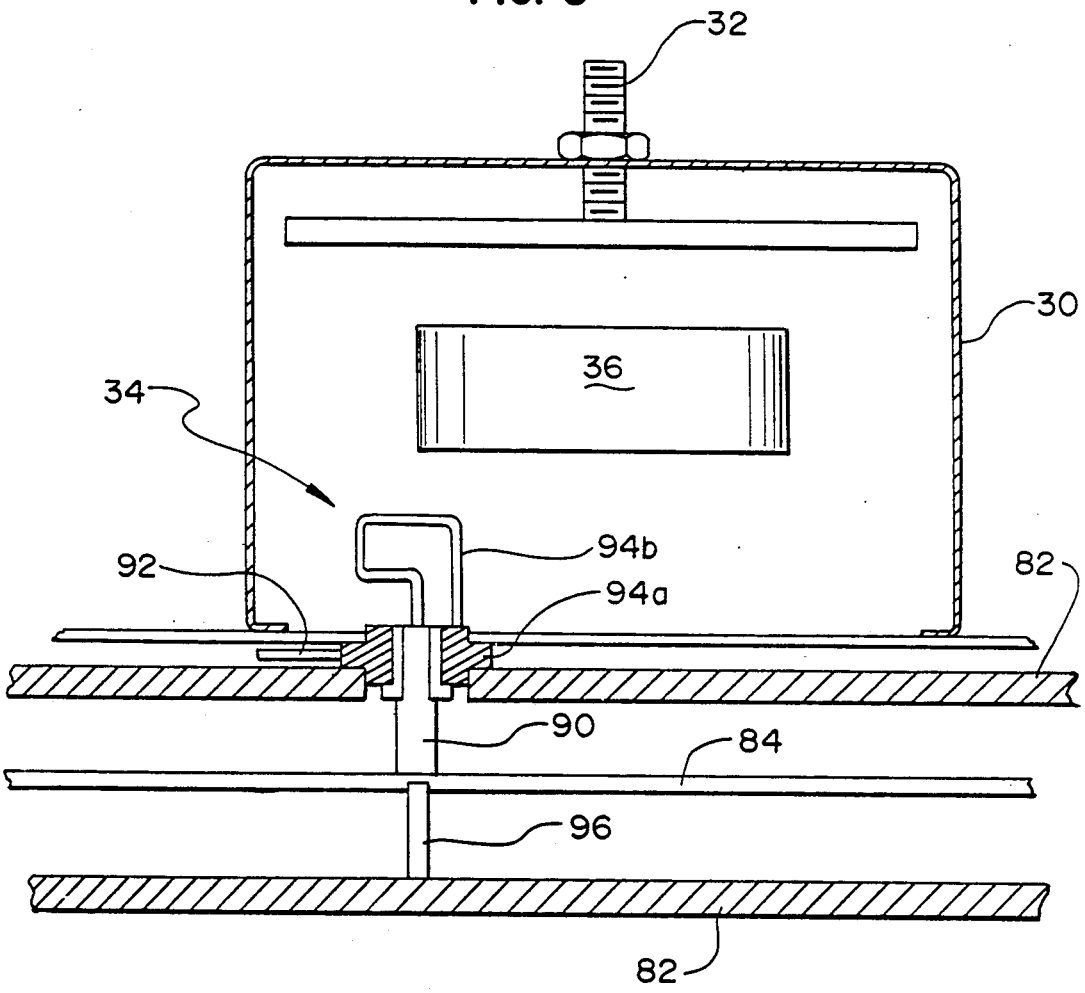
FIG. 8 is an enlarged partial view, partly in section, illustrating details of the resonator coupling loop.

FIG. 8 illustrates one of the adjustable coupling loops 34 which has an elongated cylindrical coupling member (a conductive metal post) 90 which is in electrical contact with the central conductor 84. As illustrated in FIG. 8, the coupling loop 34 is adjustable via a manually moveable handle 92 for purposes of adjusting the coupling to the respective resonator.

The post 90 of the loop 34 is insulated from the collar 94a by a REXOLITE sleeve. Adjustment of the coupling loop takes place by rotating metal collar 94a, attached to handle 92, which is in turn soldered to a portion 94b of the coupling loop 34. The collar 94a is in electrical contact with the outer metal conductor 82 and with the resonators metal housing 30. A teflon support 96 is provided beneath the rotatable member 90, for supporting the inner conductor 84 below the coupling post 90.

Figure 9:
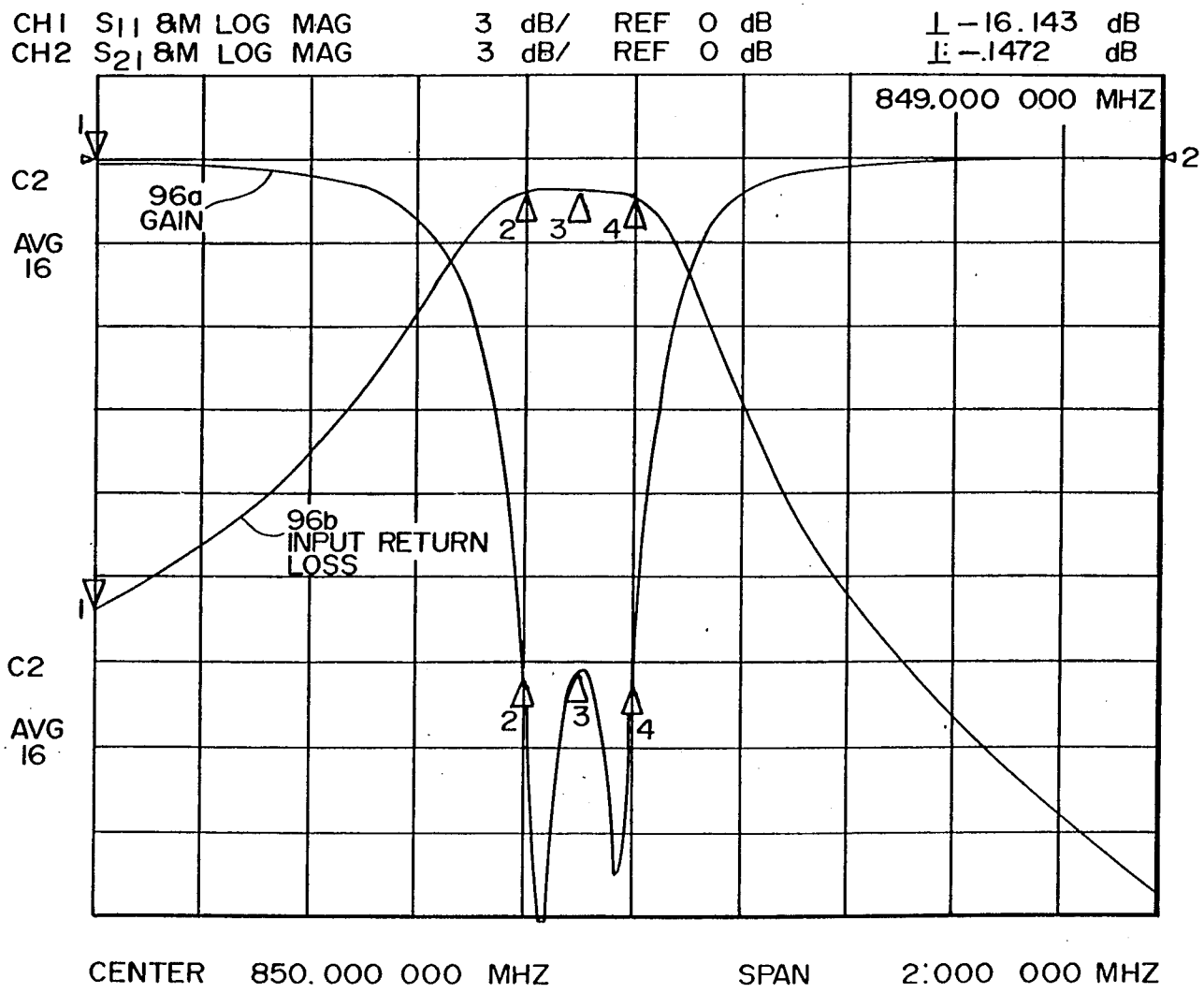
FIG. 9 is a graph illustrating the frequency characteristics of the filter of FIG. 6.

FIG. 9 includes a graph 96a of the gain of the filter, 70 and a graph 96b of the input return loss of the filter. FIG. 9 has a 2 MHz horizontal extent with each division corresponding to 3 dB.

Figure 10:
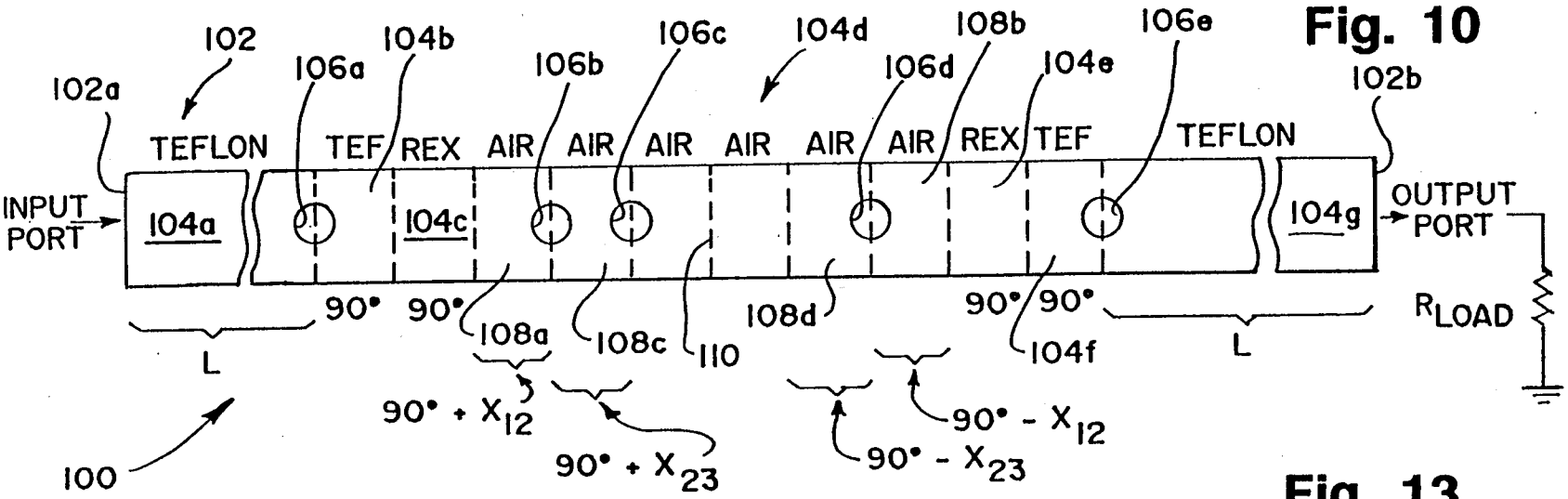
FIG. 10 is a schematic diagram of an alternate embodiment of a filter in accordance with the present invention.

FIG. 10 illustrates in a schematic view an alternate embodiment 100 of a five resonator filter which has characteristics and performance similar to those of the six resonator filter 22 illustrated in FIG. 1. The filter 100 of FIG. 10 includes a variable impedance transmission line 102 having an input end 102a and an output end 102b.

The transmission line 102 can be formed with a structure similar to the structure of the transmission line 72 of FIG. 7. The transmission line 102 includes first and second input sections 104a and 104b, each of which includes a TEFLON dielectric member and each of which has a characteristic impedance on the order of 50 ohms.

Section 104a can be of any length. Section 104b is a quarter wavelength section.

Adjacent to the input section 104b is an impedance transforming section 104c which includes REXOLITE dielectric material. The impedance transforming section 104c is a quarter wavelength section that has a characteristic impedance on the order of 73 ohms.

The central region of the transmission line 102, indicated generally at 104d, is formed of a plurality of quarter wavelength sections containing air as a dielectric material. Each of these sections has a characteristic impedance on the order of 114 ohms.

Between the central region 104d and the output end 102b, the transmission line 102 includes a further quarter wavelength section 104e with a REXOLITE dielectric material therein, comparable to section 104c, as well as two output sections 104f and 104g, each of which has a characteristic impedance on the order of 50 ohms.

The output section 104g can be of an arbitrary length. The section 104f is a quarter wavelength section.

As used herein, the phrase "common communication line" includes a line having a variety of different elements with different impedance values. For example, line 102 of FIG. 10 is a common communication line as used herein.

Cavity resonators, such as the resonators 24, 26 and 28 of FIG. 1, are coupled to the transmission line 102 at a plurality of ports 106a–106e as indicated in FIG. 10. Unlike the filter 10 of FIG. 1, the filter 100 has only three resonators in the central section 104d. Further, unlike the filter 10 of FIG. 1, wherein the resonators 26a, 26b, 28a and 28b are spaced along the central portion of the transmission line with an odd number of quarter wavelengths between each, the lengths of sections 108a and 108b have each been modified as have the lengths of the sections 108c and 108d. The sections 108a–108d are located on each side of a center line 110 for the transmission line 102.

The filter 100 of FIG. 10 will exhibit essentially the same type of performance with five resonators as does the filter 10 of FIG. 1 using six resonators. The implementation of the filter 100 is accomplished by adjusting the length of transmission lines section 108a in combination with 108b and by adjusting the length of section 108c in combination with adjusting the length of section 108d.

The spacing of the section 108a is increased an amount $X_{12}$ corresponding to an amount $X_{12}$ that the section 108b is decreased. Similarly, the length of the section 108c is increased an amount $X_{23}$ corresponding to an amount $X_{23}$ that the section 108d is decreased in length.

The actual amounts $X_{12}$, $X_{23}$ of increase or decrease of the lengths of the sections 108a–108d can be determined by using a method of elliptic function filter design published in an article by J. D. Rhodes entitled "Waveguide Bandstop Elliptic Function Filters" in November of 1972 in the *IEEE Transactions on Microwave Theory and Techniques.* That article is hereby incorporated herein by reference.

Alternately, the incremental increases and decreases $X_{12}$, $X_{23}$ to the lengths of the sections 108a 108d may be arrived at by iterative optimization using a commercially available circuit simulation computer program. One such simulation program is marketed by EEsof entitled "Touchstone".

Using the above noted method derived in the Rhodes' article, the variation $X_{12}$ of the length of sections 108a and 108b from a quarter wavelength section is on the order of 23.62 degrees. In a realized filter with a stop band centered at 845.75 MHz, the length of a quarter wavelength section from the center region 108d is on the order of 3.49 inches. Hence, the length of the section 108a as increased is on the order of 4.4 inches. The decreased length of the section 108b, decreased the same amount $X_{12}$ as section 108a has been increased, is on the order of 2.57 inches.

The incremental variations $X_{23}$ of the length of each of the sections 108c and 108d from a quarter wavelength are on the order of 11.6 degrees. Hence, the length of section 108c has been increased to a length on the order of 3.94 inches and the section 108d has been decreased similarly to a length on the order of 3.04 inches.

Figure 11:
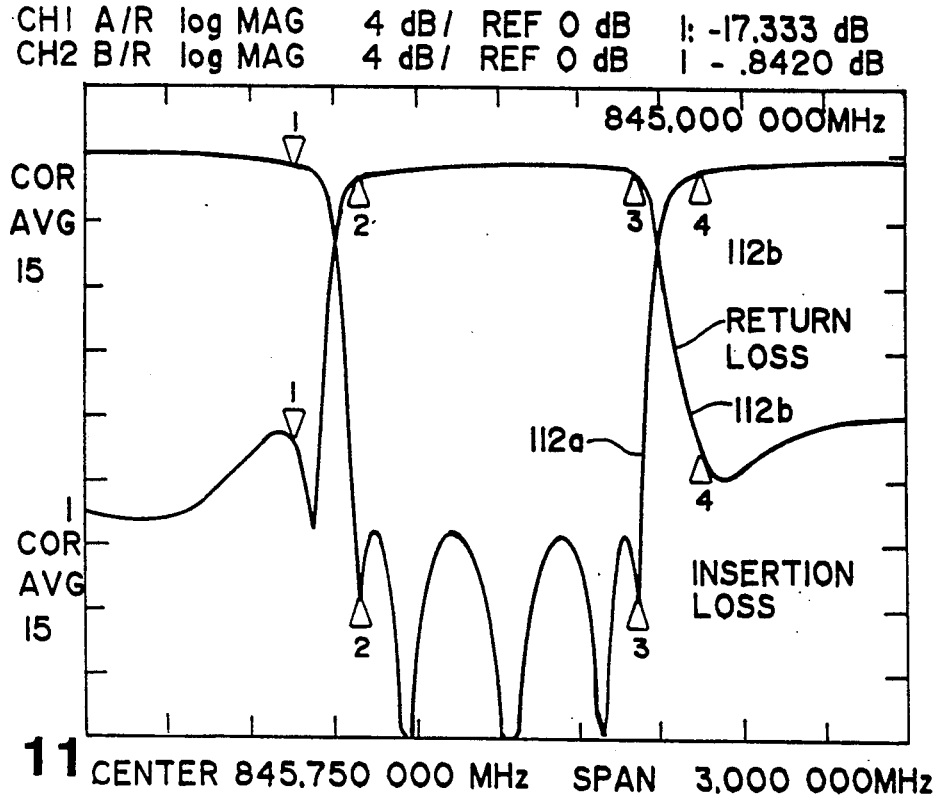
FIG. 11 is a graph illustrating the frequency characteristics of the filter of FIG. 10.

FIG. 11 illustrates a graph of a realized embodiment of the filter 100 illustrating in a curve 112a the insertion loss and in a curve 112b the return loss for the filter. Thus, as illustrated by a comparison of the diagram of FIG. 3b to the diagram of FIG. 11, results comparable to that achievable with a six resonator filter, having quarter wavelength spacings between filters in the central section 18 of the transmission line can be achieved by using a five resonator filter, as illustrated in FIG. 10, with some of the quarter wavelength center sections of the transmission line altered as described previously.

The performance of the filter 100 (as well as the filters 10 and 70 as noted previously) can be further improved by compensating for effects of the coupling loop assemblies, such as assembly 34 as well as other stray reactance effects which might be due to each respective resonator by reducing the electrical length of sections 108a–108d, a uniform amount on the order of 11–12 degrees, by way of example, of the center frequency of the notch of the filter. For example, the electrical length of the noted sections can be reduced an amount on the order of 11.3 degrees.

Figure 12:
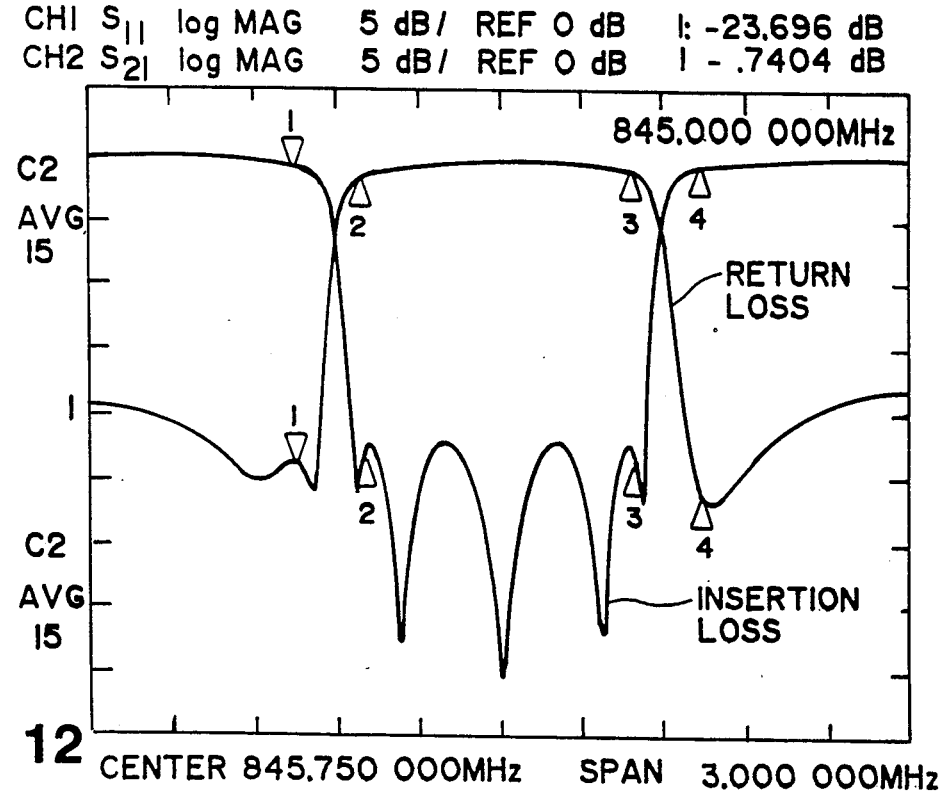
FIG. 12 is a graph illustrating the frequency characteristics of a compensated version of the filter of FIG. 10.

Section 108a now has a length on the order of 3.97 inches, section 108b has a length on the order of 2.14 inches; section 108c has a length on the order of 3.50 inches and section 108d now has a length on the order of 2.60 inches. As illustrated in FIG. 12, as a result of such a common reduction, the performance of the filter 100 becomes more symmetric with respect to the center frequency.

The plots of FIG. 12 illustrate that the overall performance of the filter 100 has been improved from a point of view of the symmetry with respect to the center frequency of the filter. In addition, FIG. 12 also illustrates that minor variations in the length of quarter wavelength sections in the central region 104d, such as might be encountered in a normal manufacturing environment, indicate that overall filter performance is not extremely sensitive to cavity spacing. Hence, filter designs of the type illustrated in FIG. 10 tend to be readily manufacturable to nominal specifications in a normal manufacturing environment.

Table 2 illustrates an exemplary frequency plan for the five resonator filter of FIG. 10. Frequencies or incremental variations thereof are expressed in MHz.

TABLE 2

| | | |
|---|---|---|
| $f_1 = 845.225 =$ | $f_0 - 0.525$ | |
| $f_2 = 845.375 =$ | $f_0 - 0.375$ | |
| $f_3 = 845.750 =$ | $f_0$ | $f_0 = 845.750$ |
| $f_4 = 846.125 =$ | $f_0 + 0.375$ | |
| $f_5 = 846.275 =$ | $f_0 + 0.525$ | |

FREQUENCY PLAN FOR 5 RESONATOR FILTER

In the scheme of Table 2, two outside resonators are tuned to frequencies $f_1$, $f_5$ an equal amount, 0.525 MHz, from the center band stop frequency $f_o$ of 845.750 MHz. Similarly, two corresponding interior resonators are each tuned to frequencies $f_2$, $f_4$ that vary from the center frequency $f_o$ on the order of 0.375 MHz.

It will be understood that either an odd number or an even number of resonators can be used without departing from the spirit and scope of the present invention.

Figure 13:
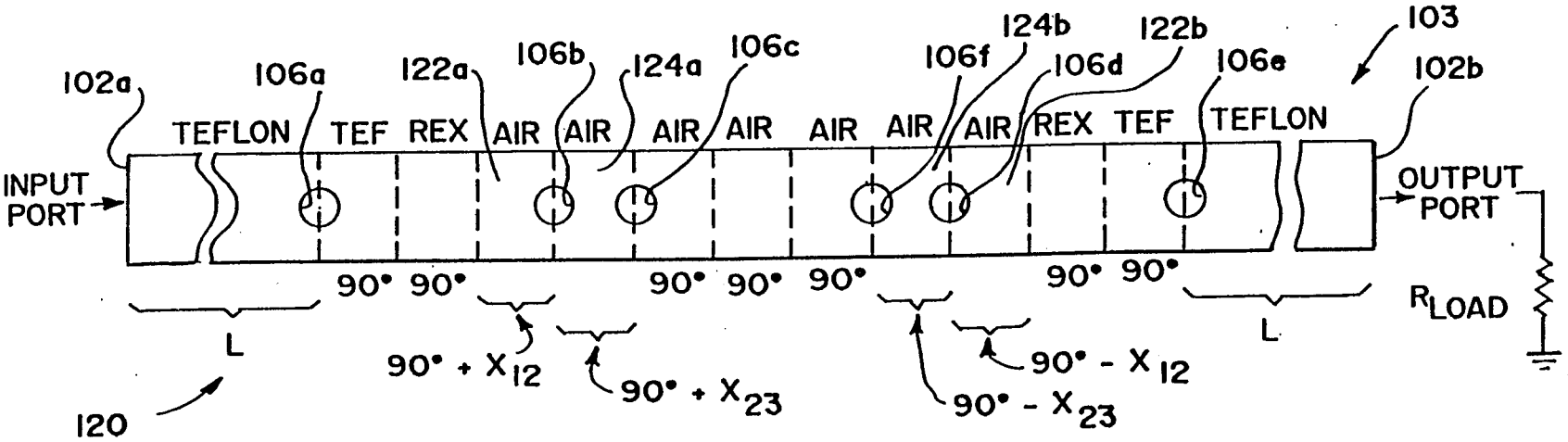
FIG. 13 is a schematic diagram, exclusive of resonators, of yet another embodiment of a filter in accordance with the present invention.

FIG. 13 illustrates a six resonator filter 120 which incorporates a stepped impedance transmission line 103, of the type illustrated in FIGS. 1 and 10. The filter 120 includes quarter wavelength sections 122*a* and 122*b* each of which is located adjacent to a respective coupling port 106*b*, 106*d* at which a respective tuned resonator can be coupled to the transmission line 103. Further, the sections 122*a* and 122*b* have been increased and decreased a respective amount $X_{12}$, as discussed previously, from a quarter wavelength section.

The filter 120 also includes modified sections 124*a* and 124*b* each of which has been altered in length from a quarter wavelength section by an amount $X_{23}$ as discussed previously. The altered sections 124*a* and 124*b* are associated respectively with ports 106*d* and 106*f* through which tuned resonators would be coupled to the transmission line 103.

It will also be understood that the impedances of the various transmission line sections illustrated in FIGS. 10 and 13 correspond generally to the impedance values indicated in FIG. 1 transmission line sections with corresponding types of dielectric materials. The filter 120 can further be compensated by shortening each of the sections 122*a*, 122*b*, 124*a*, and 124*b* a common amount k on the order of 11 to 12 degrees of the center stop band frequency of the filter. This compensation as discussed previously compensates for reactance coupling effects of the respective resonators.

Figure 14:
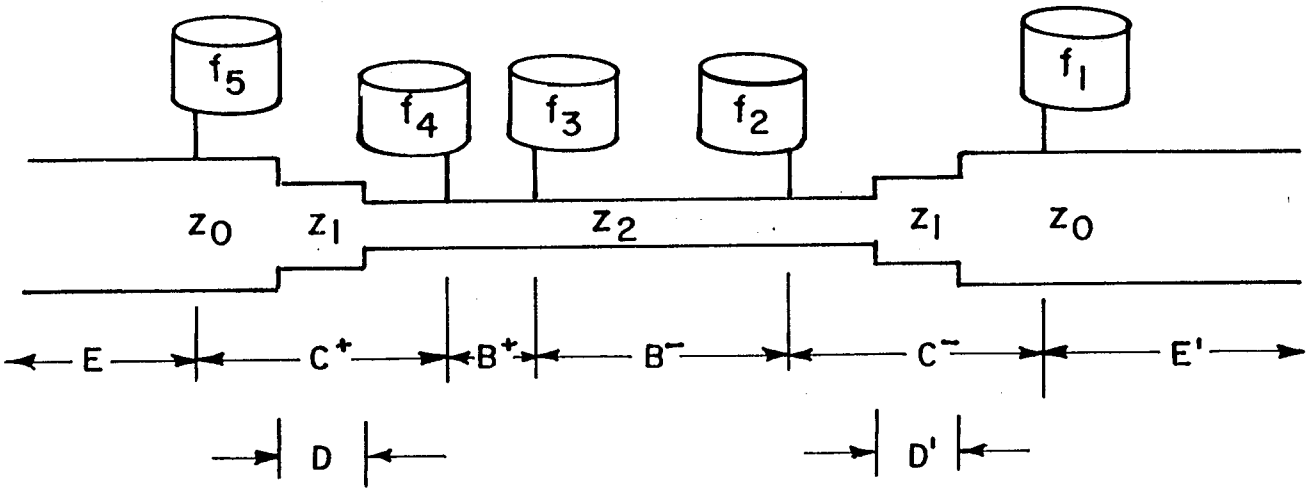
FIG. 14 is a generalized schematic block diagram view of a filter in accordance with the present invention having an odd number of resonators.
Figure 15:
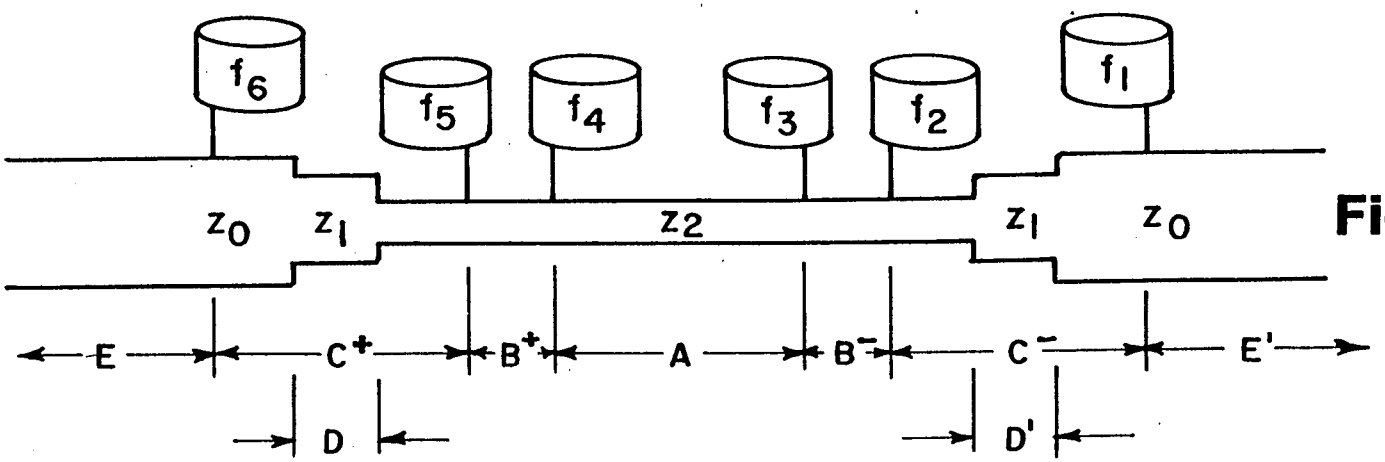
FIG. 15 is a generalized schematic block diagram of a filter in accordance of the present invention having an even number of resonators.

FIGS. 14 and 15 in combination with Table 3 below disclose more generalized representations of the previously discussed filters which embody the present invention. The filter of FIG. 14 has an odd number of resonators, comparable to the structure of FIG. 10. The filter of FIG. 15 has an even number of resonators, comparable to the structure of FIG. 13.

Table 3 illustrates various relationships, in accordance with the present invention, for the filters of FIGS. 14 and 15. In the left-most column of Table 3 each of those filters includes one or more impedance sections shortened by an amount k to compensate for the effects of transmission line discontinuities, impedance transitions and/or non-ideal coupling mechanisms. K can be used to improve the symmetry of the return loss and the insertion loss characteristics of the filter or can be used to purposely skew them to achieve a desired characteristic. Further, in the middle column of Table 3 modifications to various impedance line sections are illustrated which result in improved filter performance as previously discussed.

The right-most column of Table 3 indicates relationships for various transmission line segments associated with the impedance transformer section such as sections 16*a* and 16*b* of FIG. 1. Use of these sections increases the effective coupling of the resonators to the higher impedance central transmission line section and results in enhanced performance as described previously. The input and output sections identified as E and E′ in FIGS. 14 and 15 can be of any desired length. The values of k, $X_{12}$ and $X_{23}$ can be zero or greater as discussed previously.

TABLE 3

| Compensated | Modified | Impedance Transformer Section Enhanced |
|---|---|---|
| $A = n_1{*}90° - k$ | | |
| $B = n_2{*}90° - k$ | $B^+ = B + X_{23}$ | |
| $B' = n_3{*}90° - k$ | $B^- = B' - X_{23}$ | |
| $C = n_4{*}90° - k$ | $C^+ = C + X_{12}$ | |
| $C' = n_5{*}90° - k$ | $C^- = C' - X_{12}$ | |

TABLE 3-continued

| Compensated | Modified | Impedance Transformer Section Enhanced |
|---|---|---|
| | | $D = C^+$, for $n_4 = 1$<br>$m_4{*}90°$, for $n_4 \geqq 3$ |
| | | $D' = C^-$, for $n_5 = 1$<br>$m_5{*}90°$, for $n_5 \geqq 5$ |

$n_i$ is an odd integer greater than or equal to one for i = 1 to 5 in the table above. $m_i$ is an odd integer greater than or equal to one and less than $n_i$ for i = 4 and 5 in the table above.

It will be understood that impedance transformers, other than transmission line sections, can be used without departing from the spirit and scope of the present invention. FIGS. 16–19 illustrate schematically alternate filter structures in accordance with the present invention. In FIGS. 16 and 18 an odd number of resonators is disclosed. In FIGS. 17 and 19 an even number of resonators is disclosed.

In the filter of FIG. 16, an odd number of resonators 150*a*–150*c*, is coupled via coupling means, such as coupler 152 to a fixed impedance transmission line 154. The line 154 terminates in first and second impedance transformers 156*a*, 156*b*.

As illustrated in FIG. 16, line 154 is divided into a region 154*a* having a length "A" and a region 154*b* having a length "B". A center line 154*c* is illustrated about which there is pairwise symmetry in resonator frequencies.

The resonator frequencies bear the following relationships to one another:

$$f_3 > f_2 > f_1$$

$$f_0 = f_2 = f_1 + f_3$$

The lengths A and B can be determined as follows:

$$A = n_1{*}90^0 + x - k$$

$$B = n_2{*}90^0 - x - k$$

$n_1$ and $n_2$ are odd integers that are greater than or equal to one. The value of k can be any amount. One of x or k can also equal zero.

In the Filter of FIG. 17, an even number of resonators, 150*a*–150*d*, is coupled to the fixed impedance transmission line 154. Corresponding elements in FIG. 17 carry the same identification numerals as in FIG. 16.

FIG. 17 illustrates a center region 154*d* about which there is pair-wise symmetry in resonator frequencies. The values of A, B, x and k are determined as above. The length of the region 154 can be determined from:

$$C = n_3{*}90^0 - k$$

$n_3$ is an odd integer greater than or equal to one. The resonator frequencies bear the following relationships to one another;

$$f_4 > f_3 > f_2 > f_1$$

$$f_0 = \frac{f_2 + f_3}{2} = \frac{f_1 + f_4}{2}$$

In the filter of FIG. 18, an odd number of resonators 150*a*–150*c* is coupled, in part, to a centrally located, fixed impedance transmission line 160, and in part to spaced-apart fixed impedance transmission lines 162, 164.

The line 160 has an impedance $Z_2$. The lines 162, 164 each have an impedance $Z_0$ where $Z_2 > Z_0$.

The values of A, B in FIG. 18 are determined as are the corresponding values in FIG. 16. The frequencies of the resonators of FIG. 18 bear the same relationship to one another as do the frequencies of the resonators of FIG 16.

In the filter of FIG. 19, and even number of resonators, 150*a*–150*d*, is coupled to constant impedance transmission lines 160, 162, and 164. Elements in FIG. 19 which correspond to elements in FIGS. 16–18 have been assigned the same identification numeral.

The values of A, B, C of FIG. 19 can be determined as described above in connection with FIG. 17. The frequency relationships for the filter of FIG. 19 are the same for the filter of FIG. 17. In FIGS. 10, 13, and 16–19, the lengths of constant impedance transmission lines indicated by the symbol "L" can be any convenient length.

From the foregoing, it will be observed that numerous variations and modifications may be effected without departing from the spirit and scope of the novel concept of the invention. It is to be understood that no limitation with respect to the specific apparatus illustrated herein is intended or should be inferred. It is, of course, intended to cover by the appended claims all such modifications as fall within the scope of the claims.

What is claimed is:

1. A bandstop filter comprising:

a common communication line having a first end and a second end including a plurality of quarter wavelength sections therebetween; and a plurality of substantially identical, tunable dielectric resonators spaced along and coupled to said line wherein one of said quarter wavelength sections, adjacent to a first resonator from said plurality, is increased in length a predetermined amount thereby forming a first modified section and wherein a second of said quarter wavelength sections, adjacent to a second resonator from said plurality, is decreased in length said predetermined amount thereby forming a second modified section.

2. A filter as in claim 1 with a third member of said plurality of resonators adjacent to said first modified section.

3. A filter as in claim 2 with a fourth member of said plurality adjacent to said second modified section.

4. A filter as in claim 1 with said line including a central transmission line section having a characteristic impedance of a first value extending between said ends with first and second impedance transformers coupled thereto at respective of said ends.

5. A filter as in claim 4 with each of said impedance transformers including an impedance transforming transmission line section with a characteristic impedance of a second value, less than said first value.

6. A filter as in claim 1 with selected resonators of said plurality tuned to different frequencies.

7. A filter as in claim 1 with each said resonator including a mechanism for coupling to said line with selected resonators of said plurality coupled thereto in varying degrees.

8. A filter as in claim 1 with each said resonator including means for coupling to a respective section of said line and with a selected parameter of all of said modified sections reduced a predetermined compensating amount.

9. A filter as in claim 1 with said plurality of resonators having an even number of resonators.

10. A filter as in claim 1 with said plurality of resonators having an odd number of resonators.

11. A filter as in claim 10 wherein said plurality of resonators include five resonators with a third quarter wavelength section adjacent to said first resonator increased in length by a second predetermined amount and a fourth quarter wavelength section adjacent to said second resonator decreased in length by said second predetermined amount.

12. A filter as in claim 11 with each said modified section reduced a predetermined compensating amount.

13. A filter as in claim 1 wherein said communication line includes lower impedance input and output sections coupled to a higher impedance central portion, and wherein at least one of said resonators is coupled to said central portion.

14. A bandstop filter comprising:

a transmission line having first and second ends joined by a plurality of interconnected internal sections with each said internal section having a predetermined electrical length;

a plurality of substantially similar resonators spaced along and coupled to selected ones of said internal sections of said transmission line with at least a selected, first internal section, increased in length a predetermined amount thereby forming a first modified section and a selected second internal section decreased in length said predetermined amount thereby forming a second modified section; and first and second impedance transformers coupled respectively to said ends.

15. A bandstop filter as in claim 14 wherein said resonators are tuned to various selected frequencies.

16. A bandstop filter as in claim 14 wherein each of said modified sections is reduced a predetermined, common coupling compensating amount.

17. A bandstop filter as in claim 14 with each said impedance transformer including an impedance transforming transmission line section with a characteristic impedance value that is different from a characteristic impedance value of said transmission line.

18. A bandstop filter as in claim 14 with each said section having a common characteristic impedance value and said impedance transformers having impedance values that are different from said common characteristic value.

19. A bandstop filter as in claim 14 with at least first and second resonators located on said transmission line at first and second modified sections respectively.

20. A bandstop filter as in claim 14 with each said resonator including means for coupling to a respective section of said transmission line and wherein a selected parameter of each of said modified sections is reduced a predetermined amount to compensate for effects of said coupling means.

21. A filter as in claim 14 with a selected parameter of each of said modified sections reduced a predetermined common coupling compensating amount.

22. A bandstop filter with a center frequency $f_0$ having an associated quarter wavelength comprising:

a multi-section transmission line with a first end, and a second end, said line including a plurality of interconnected sections, with each said section an odd number of quarter wavelengths long and extending between said ends with said members of said plurality of sections each having a predetermined, characteristic impedance value wherein at least one of said impedance values is different from the others;

a plurality of substantially identical resonators spaced along and coupled to selected ones of said sections with at least a first section, increased in length a predetermined amount thereby forming a first modified section and a corresponding second section, decreased in length said predetermined amount thereby forming a second modified section and with said members of said plurality of resonators tuned to different frequencies, wherein each said resonator includes an element for adjustably coupling to said selected section and wherein said elements are substantially identical.

23. A bandstop filter with a center frequency $f_0$ having an associated quarter wavelength comprising:

a transmission line having a first end and a second end, and a first characteristic impedance value, first and second impedance transformers coupled respectively to each of said ends;

a plurality of substantially identical, tunable dielectric resonators spaced on and coupled to said line with selected resonators of said plurality tuned to different frequencies with a first pair of resonators joined by a portion of said line and with a second pair joined by a different portion thereof wherein said portion and said different portion are respectively increased and decreased in length a common amount.

24. A filter as in claim 23 with each said impedance transformer including an impedance transforming transmission line section of a selected length and said impedance different from said first characteristic impedance.

25. A filter as in claim 23 wherein said transmission line includes a plurality of quarter wavelength sections wherein a length parameter of each of selected sections of said plurality is reduced a common coupling compensating amount.

26. A filter as in claim 23 including second and third transmission line sections coupled respectively to said first and second impedance transformers with said second and third sections each having a characteristic impedance value different from said first value.

27. A filter comprising:

an elongated transmission line having a first impedance value, a first end and a second end;

a first resonator coupled to said transmission line;

a second resonator coupled to said transmission line on one side of said first resonator and spaced therefrom a distance corresponding to an odd number of quarter wavelengths, decreased by a predetermined amount thereby forming a decreased section;

a third resonator coupled to said transmission line on a second side of said first resonator and spaced therefrom a distance corresponding to an odd number of quarter wavelengths increased by said predetermined amount thereby forming an increased section;

first and second impedance transforming transmission line sections, each of said sections having a characteristic impedance with a value less than said first impedance and with one of said sections coupled to said first end and the other to said sections coupled to said second end.

28. A filter as in claim 27 with each said impedance transforming section having an electrical length on the order of an odd number of quarter wavelengths.

29. A filter as in claim 27 with said increased and said decreased sections each shortened a predetermined common compensation amount.

30. A filter as in claim 29 with said shortened, predetermined, compensation amount corresponding to an electrical length in a range of 12 to 14 percent of a quarter wavelength.

31. A bandstop filter comprising:

a stepped impedance transmission line having first and second ends and a plurality of quarter wavelength sections therebetween with selected ones of said sections having a characteristic impedance value in excess of a characteristic impedance value of other sections; and a plurality of substantially identical resonators spaced along and coupled to said transmission line with said plurality of resonators including a first resonator, a second resonator located on one side of said first resonator, spaced therefrom by an odd number of quarter wavelength sections of said transmission line, wherein one of said quarter wavelength sections has a length in excess of a quarter wavelength by a predetermined amount;

a third resonator located on the other side of said first resonator, spaced therefrom by an odd number of quarter wavelength sections of said transmission line, one selected section of which has a length that is reduced from a quarter wavelength by said predetermined amount.

32. A filter as in claim 31 with said plurality of resonators including an even number of substantially identical resonators.

33. A filter as in claim 31 with said selected section each shortened in length by a predetermined, common compensating amount.

34. A filter as in claim 31 with a predetermined center frequency and wherein selected of said resonators are tuned to frequencies above the center frequency and others of said resonators are tuned to frequencies below the center frequency.

35. A bandstop filter with a center frequency $f_0$ having an associated quarter wavelength comprising:

a common communication line, having a first end and a second end, including a plurality of sections therebetween, wherein each said section has an electrical length corresponding to an odd number of quarter wavelengths with each said section reduced from said odd number of quarter wavelengths in electrical length by a uniform compensating amount, wherein said communication line includes a first, central, transmission line having a characteristic impedance of a first value, and wherein said communication line also includes first and second impedance transformers, each coupled to a respective end of the central transmission line, and a plurality of substantially identical tunable, dielectric resonators spaced along said communication line and coupled in varying degrees to said line, with selected of said resonators located adjacent to at least one of said reduced length sections;

wherein at least some of said resonators are coupled to said central transmission line with selected resonators of said plurality tuned to frequencies above the center frequency and with others tuned to frequencies below the center frequency; and wherein two of said resonators have resonant frequencies of $f_1$ and $f_2$, respectively, wherein said resonators are tuned such that said center frequency is approximately equal to $(f_1+f_2)/2$, and wherein one of said reduced length sections has one of said resonators coupled to one end thereof and another of said resonators is coupled to another end thereof.

36. A filter as in claim 35 with each of said impedance transformers including a transmission line impedance transformer having an electrical length on the order of an odd number of quarter wavelengths and having a characteristic impedance value different than said first impedance value.

37. A filter as in claim 35 wherein said resonator frequencies $f_1$ and $f_2$ are approximately 849.8 MHz and 850.0 MHz, respectively; and said first impedance value is approximately 114 ohms, said impedance transformers each have an impedance of approximately 75 ohms, and wherein said compensating amount is approximately 11.3 degrees at the said center frequency.

38. A bandstop filter with a center frequency $f_0$ having an associated quarter wavelength comprising:

a common communication line, having a first end and a second end, including a plurality of sections therebetween, wherein each said section has an electrical length corresponding to an odd number of quarter wavelengths with each said section reduced from said odd number of quarter wavelengths in electrical length by a uniform compensating amount;

wherein said communication line includes a first, central, transmission line having a characteristic impedance of a first value, and wherein said communication line also includes first and second impedance transformers, each coupled to a respective end of the central transmission line, and a plurality of substantially identical tunable, dielectric resonators spaced along said communication line and coupled in varying degrees to said line, with selected of said resonators located adjacent to at least one of said reduced length sections;

wherein at least some of said resonators are coupled to said central transmission line;

wherein each of said impedance transformers includes a transmission line impedance transformer having an electrical length on the order of an odd number of quarter wavelengths and has a characteristic impedance value different than said first impedance value;

wherein some of said resonators are tuned to frequencies above the center frequency and others are tuned to frequencies below the center frequency;

a conductive housing; a low loss, high dielectric constant, ceramic material, supported with low loss material within said housing, an adjustable frequency tuning mechanism carried by said housing, and an adjustable coupling mechanism carried by said housing.

39. A filter as in claim 36 wherein the said transmission lines include:

an outer conductor of a selected cross section, a round wire inner conductor, which is electrically isolated from and concentrically supported within, said outer conductor with low loss dielectric materials.

40. A filter as in claim 38 wherein the said adjustable coupling mechanism comprises:

a rotatable conductive flat circular ring with a handle attachment means in electrical contact with said transmission line outer conductor and with said resonator conductive housing, a conductive wire loop attached to said conductive ring and extending within said resonator conductive housing to within close proximity of said dielectric resonator, an elongated conductive post attached to said wire loop and extending through the center of said ring and through a hole in said outer conductor to make electrical contact with said inner conductor, and a dielectric sleeve within said ring to electrically insulate said conductive post.

41. A filter as in claim 36 wherein selected sections of said plurality are increased in electrical length by predetermined amounts forming expanded sections, and wherein others of said sections are decreased in electrical length by said predetermined amounts forming contracted sections.

42. A filter as in claim 41 wherein said communication line includes second and third transmission lines coupled to said first and second impedance transformers, respectively, and wherein said second and third transmission lines have second and third characteristic impedance values, respectively, which differ from said first characteristic impedance value.

43. A filter as in claim 42 including five of said resonators having frequencies $f_1$, $f_2$, $f_3$, $f_4$, and $f_5$ respectively, wherein said resonators are tuned such that said center frequency is approximately equal to each of $f_3$, $(f_2+f_4)/2$, and $(f_1=f_5)/2$ and including two of said expanded sections and two of said contracted sections.

44. A filter as in claim 43 including a center line with an equal number of resonators disposed on each side thereof, wherein said increased amounts of said two expanded sections are $X_1$ and $X_2$, respectively and wherein said decreased amounts of said two contracted sections are the same $X_1$ and $X_2$ respectively; and where said sections which have been altered by amounts $X_1$ and $X_2$ form modified respective section pairs, and where members of each said pair are disposed symmetrically about said center line.

* * * * *